US008630786B2

(12) United States Patent
Jackson et al.

(10) Patent No.: US 8,630,786 B2
(45) Date of Patent: Jan. 14, 2014

(54) LOW PURGE FLOW VEHICLE DIAGNOSTIC TOOL

(75) Inventors: Robert Jackson, Brighton, MI (US); William R. Cadman, Fenton, MI (US); Kurt D. McLain, Clarkston, MI (US); David Edward Prout, Linden, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 659 days.

(21) Appl. No.: 12/823,281

(22) Filed: Jun. 25, 2010

(65) Prior Publication Data

US 2011/0315127 A1 Dec. 29, 2011

(51) Int. Cl.
*F02M 33/02* (2006.01)

(52) U.S. Cl.
USPC ..... 701/107; 123/521; 73/114.39

(58) Field of Classification Search
USPC ..... 123/516, 518, 519, 520, 521; 73/114.39, 114.43; 701/103, 106, 107
See application file for complete search history.

(56) References Cited

U.S. PATENT DOCUMENTS 6,112,728 A 9/2000 Schwegler et al.
6,837,224 B2 * 1/2005 Kidokoro et al. ..... 123/520
6,988,396 B2 * 1/2006 Matsubara et al. ..... 73/114.39
7,043,972 B2 * 5/2006 Matsubara et al. ..... 73/114.39
7,082,815 B1 * 8/2006 Matsubara et al. ..... 73/114.39
7,213,450 B2 * 5/2007 Matsubara et al. ..... 73/114.39
7,426,608 B1 9/2008 Kao
7,441,549 B2 10/2008 Takayanagi
7,481,101 B2 * 1/2009 Matsubara et al. ..... 73/114.39
8,019,525 B2 * 9/2011 DeBastos et al. ..... 701/102
8,397,552 B2 * 3/2013 Jackson et al. ..... 73/49.3
2009/0216426 A1 8/2009 Wang et al.

* cited by examiner

*Primary Examiner* — Hai Huynh
(74) *Attorney, Agent, or Firm* — Quinn Law Group, PLLC

(57) ABSTRACT

A vehicle includes an engine, a sealed fuel system having a fuel tank, a canister for storing fuel vapor, a vapor circuit external to the fuel tank, and a control valve. The vapor circuit includes an absolute pressure sensor and a switching valve connecting the fuel tank to the control valve. A controller evaluates or diagnoses a vapor purge function of the sealed fuel system using vacuum measurements from the absolute pressure sensor, executing or diagnosing only when the engine is running, purge is enabled, and the pump is off. The controller diagnoses the vapor purge function by comparing the vacuum measurements to a threshold vacuum. An apparatus includes the vapor circuit and controller. A method for diagnosing the vapor purge function includes actuating the switching valve, measuring a vacuum in the system using the absolute pressure sensor, and comparing the measured vacuum to a threshold vacuum.

11 Claims, 3 Drawing Sheets

LOW PURGE FLOW VEHICLE DIAGNOSTIC TOOL

TECHNICAL FIELD

The present invention relates to a method and apparatus for detecting or diagnosing fuel vapor purge functionality in a sealed fuel system aboard a vehicle.

BACKGROUND

Vehicle fuel systems store and supply fuel used by an internal combustion engine. A typical vehicle fuel system includes a fuel tank, a pump operable for drawing fuel from the tank, and fuel lines interconnecting various fuel handling components. A filter may also be included within the fuel system to remove suspended particulate matter and other entrained contaminants prior to combustion of the fuel within the engine's cylinder chambers. A fuel regulator maintains sufficient pressure in the fuel lines, and also cycles excess fuel to the fuel tank.

In order to prevent fuel vapor from escaping into the surrounding atmosphere, vehicles may include equipment that isolates and stores vapor from the fuel tank, and that ultimately purges the stored vapor to the engine intakes. Certain vehicles, such as extended-range electric vehicles (EREV) or plug-in hybrid electric vehicles (PHEV), use sealed fuel systems to substantially prevent atmospheric discharge of hydrocarbon vapors, thus helping to minimize the vehicle's environmental impact.

SUMMARY

Accordingly, an algorithm and apparatus are provided herein for use aboard a vehicle having a sealed fuel system. Execution of the algorithm diagnoses vapor purge functionality in the sealed fuel system. Such systems may be used aboard vehicles having relatively short engine run cycles. For example, an extended-range electric vehicle (EREV) has an engine that, when it runs at all, typically does so at wide-open throttle over a short operating duration. Plug-in hybrid electric vehicles (PHEV) and other emerging vehicle designs having sealed fuel systems may also be used with the diagnostic algorithm and apparatus as set forth herein.

In particular, a vehicle as disclosed herein includes an internal combustion engine, a sealed fuel system having a fuel tank, a canister for storing fuel vapor from the fuel tank, a vapor circuit positioned external to the fuel tank and in fluid communication with the fuel tank, and a control valve. The control valve is operable for controlling a flow of fuel vapor from the vapor circuit into the canister, wherein the vapor circuit includes an absolute pressure sensor, a pump, and a switching valve selectively connecting the fuel tank to the absolute pressure sensor when the control valve is open. The vehicle further includes a controller having an algorithm for evaluating or diagnosing a vapor purge function of the sealed fuel system using vacuum measurements from the absolute pressure sensor. The controller executes the algorithm only when the engine is running, vapor purge is enabled, and the pump is off, and diagnoses the vapor purge function by comparing the vacuum measurements to a calibrated vacuum.

The controller may actuate the switching valve to thereby place the pump in fluid communication with the rest of the sealed fluid system, and thereafter measure the vacuum in the sealed fuel system using the absolute pressure sensor to thereby determine the vacuum measurements. A purge valve selectively connects the canister to the engine, and a fuel tank pressure sensor measures a gauge pressure level in the fuel tank. The controller opens the purge valve and control valve simultaneously when the fuel tank pressure sensor measures a vacuum in the fuel tank, and opens the purge valve a calibrated amount of time before the control valve when the fuel tank pressure sensor measures a pressure in the fuel tank.

The controller is operable for executing a time delay equal to a first delay value when the fuel tank pressure sensor detects a vacuum in the fuel tank, and equal to a second delay value when the fuel tank pressure sensor detects a pressure in the fuel tank. The controller may execute the algorithm after the second delay even when pressure remains in the fuel tank.

An apparatus for use aboard a vehicle having the sealed fuel system includes a vapor circuit positioned external to the fuel tank and in fluid communication with the fuel tank and the control valve, and having an absolute pressure sensor, a pump, and a switching valve selectively connecting the fuel tank to the absolute pressure sensor when the control valve is open. A controller evaluates or diagnoses a vapor purge function of the sealed fuel system using vacuum measurements from the absolute pressure sensor. The controller executes a diagnostic algorithm only when the engine is running, vapor purge is enabled, and the pump is off, and diagnoses the vapor purge function by comparing the vacuum measurements to a calibrated vacuum.

A method is also disclosed for evaluating or diagnosing a vapor purge function of a sealed fuel system aboard a vehicle having an internal combustion engine and a fuel tank. The method includes actuating a switching valve in a vapor circuit positioned external to the fuel tank when the engine is running and a fuel system purge cycle is enabled, the vapor circuit including an absolute pressure sensor and a pump. The method then includes measuring a vacuum level using the absolute pressure sensor while the pump is off, comparing the vacuum level from the absolute pressure sensor to an initial vacuum level after a control valve is opened and the switching valve is activated to thereby determine a vacuum differential, and executing a control action corresponding to the vacuum differential.

The method may also include detecting the gauge pressure in the fuel tank using the fuel tank pressure sensor, and simultaneously opening the purge valve and the diurnal control valve only when the gauge pressure corresponds to a vacuum.

The above features and advantages and other features and advantages of the present invention are readily apparent from the following detailed description of the best modes for carrying out the invention when taken in connection with the accompanying drawings.

DETAILED DESCRIPTION

Figure 1:
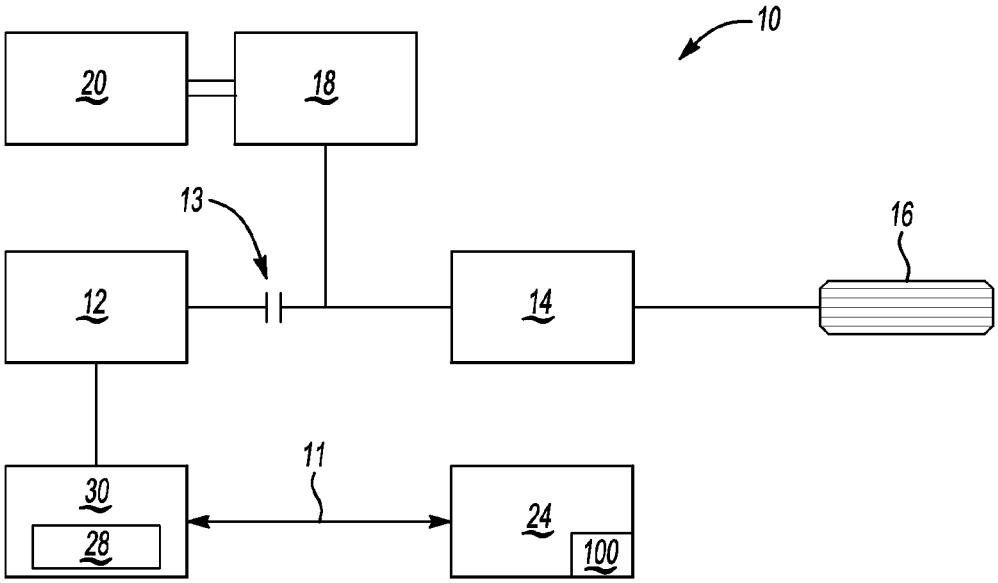
FIG. 1 is a schematic illustration of a vehicle having a vapor purge diagnostic algorithm and apparatus as set forth herein.

Referring to the drawings, wherein like reference numbers correspond to like or similar components throughout the several figures, and beginning with FIG. 1, a vehicle 10 includes a vapor purge diagnostic algorithm 100 as described below. Vehicle 10 includes an internal combustion engine 12 that is selectively connectable to a transmission 14 via a clutch 13. Engine torque is ultimately transferrable through the clutch 13 to a set of wheels 16 to thereby propel the vehicle 10. Vehicle 10 may also include at least one electric motor/generator unit (MGU) 18 capable of selectively delivering motor torque to the wheels 16, either in conjunction with or independently of the transfer of engine torque to the wheels from the engine 12, depending on the design of the vehicle.

MGU 18 is adapted for generating electrical energy for onboard storage within an energy storage system (ESS) 20, e.g., a rechargeable high-voltage direct current battery. ESS 20 may be recharged using an off-board power supply (not shown) when used aboard a plug-in hybrid electric vehicle (PHEV), or directly by the MGU 18, for example during a regenerative braking event or other regenerative event. Vehicle 10 may be alternatively configured as an extended-range electric vehicle (EREV) as noted above, an emerging design wherein the ESS 20 electrically powers the vehicle over a threshold distance or operating range before starting the engine 12, and thereafter using engine torque to recharge the ESS and/or MGU 18 to thereby indirectly power the vehicle.

A controller 24, e.g., a hybrid engine control module or other suitable host machine, is programmed with or that has access to diagnostic algorithm 100. Controller 24 may include one or more digital computers each having a microprocessor or central processing unit, read only memory (ROM), random access memory (RAM), electrically-erasable programmable read only memory (EEPROM), a high-speed clock, analog-to-digital (A/D) and/or digital-to-analog (D/A) circuitry, and input/output circuitry and devices (I/O), as well as appropriate signal conditioning and buffer circuitry. Any algorithms resident in the controller 24 or accessible thereby, including algorithm 100, can be automatically executed by the controller to provide the required functionality.

Still referring to FIG. 1, the vehicle 10 also includes a sealed fuel system 30, which is in communication with the controller 24 via signals 11. As used herein, the term "sealed fuel system" refers to a fuel system configured to seal at all times other than during a refueling event, wherein an insertion of a gas nozzle at a refueling station temporarily breaks the seal. By sealing the sealed fuel system 30 substantially all of the time, atmospheric venting of hydrocarbon vapors is largely prevented during normal vehicle operation. The sealed fuel system 30 includes a vapor circuit 28, which as used herein is an Evaporative Leak Check Pump (ELCP) circuit having a set of fluid control components or hardware as described in detail below with reference to FIG. 2. Certain elements of vapor circuit 28 are used in conjunction with execution of the algorithm 100 to provide a low purge flow diagnostic tool suitable for evaluating the proper vapor purge functionality of the sealed fuel system 30.

Figure 2:
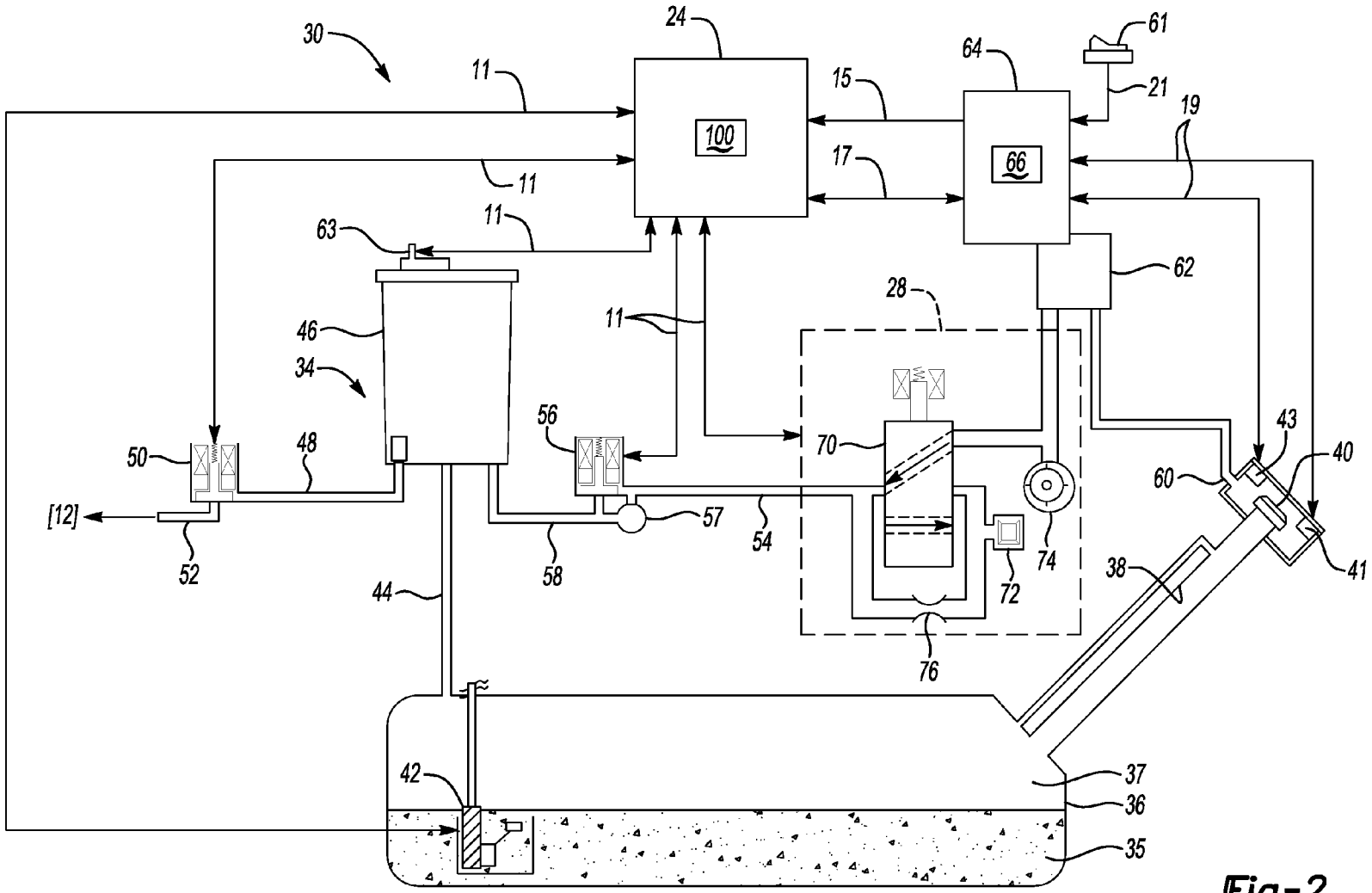
FIG. 2 is a schematic illustration of a control module usable with the vehicle shown in FIG. 1.

Referring to FIG. 2, in addition to the vapor circuit 28 noted above, the sealed fuel system 30 includes an evaporative emission control (EVAP) system 34, a fuel tank 36, a fuel inlet 38, a fuel cap 40, and a modular reservoir assembly (MRA) 42. EVAP system 34 includes a first fuel vapor line 44, an EVAP canister 46, a second fuel vapor line 48, a purge valve 50, and a first fuel vapor line 52 that feeds the intakes of engine 12 (see FIG. 1). First fuel vapor line 44 connects the fuel tank 36 to canister 46, and the second fuel vapor line 48 connects the canister to the purge valve 50. EVAP system 34 further includes a third fuel vapor line 54, a control valve 56, a relief valve 57, and a second fuel vapor line 58 connecting the control valve to the canister 46.

In one embodiment, the control valve 56 may be configured as a solenoid-actuated diurnal control valve suitable for controlling a flow of fresh air when purging the canister 36, or fuel vapor when refueling the canister, and may be normally closed to further minimize vapor emissions. Control valve 56 can be selectively opened to allow fuel vapor residing within canister 46 to be purged to the engine 12 (see FIG. 1) at certain predetermined times when the engine is running, e.g., at least once per trip as explained below with reference to FIG. 3.

Fuel tank 36 contains a mix of liquid fuel 35 and fuel vapor 37. The fuel inlet 38 extends from the fuel tank 36 to the fuel cap 40, thus enabling filling of the fuel tank. Fuel cap 40 closes and seals the fuel inlet 38, and may include a fresh air opening 60 in fluid communication with a filter 62, e.g., a mesh, screen, sintered element, or other suitable filter media. Cap 40 may include a position sensor 41 and a lock solenoid 43 to optimize sealing functionality.

A vehicle integration control module (VICM) 64 having a clock 66 communicates with the lock solenoid 43 and with the position sensor 41, as indicated in FIG. 2 by arrows 19. In some vehicle designs, such as certain EREVs, an optional refuel request button or switch 61 may be used. Switch 61 is in communication with the VICM 64, with an operator actuating the switch to generate signals 21 signaling for a relief of excess pressure or vacuum prior to unlocking of the fuel cap 40 during refueling.

Still referring to FIG. 2, MRA 42 is positioned within the fuel tank 36, and is adapted for pumping liquid fuel 36 to the engine 12 shown in FIG. 1. Fuel vapor 37 flows through the first fuel vapor line 44 into canister 46, which temporarily stores the fuel vapor. Second fuel vapor line 48 connects canister 46 to the purge valve 50, which is initially closed. Controller 24 controls the purge valve 50 to selectively enable fuel vapor 37 to flow through the fuel vapor line 52 into the intake system (not shown) of engine 12 (see FIG. 1), where it is ultimately combusted. Vapor also flows from vapor circuit 28, through the third fuel vapor line 54, and to the control valve 56, with the control valve being initially closed. Controller 24, which communicates with the control valve 56 and the vapor circuit 28 via the signals 11, ultimately controls operation of the control valve to selectively enable fuel vapor to flow through line 58 into the canister 46 as noted above.

Controller 24 controls and is in communication with the MRA 42, the purge valve 50, and the control valve 56. The controller 24 is further in communication with a fuel tank (FT) pressure sensor 63, which in turn is adapted for measuring gauge pressure in the fuel tank 36, i.e., a positive pressure or a vacuum. In an EREV and other partial zero-emissions vehicles (PZEV), the FT pressure sensor 63 may be positioned on/within canister 46 as shown in FIG. 2, although other designs may place the FT pressure sensor within the fuel tank 36.

Regardless of where it is placed, the FT pressure sensor 63 is in communication with the controller 24, which in turn is in communication with VICM 64 over a serial bus 17. Clock 66 generates time signals 15 and transmits the same to the VICM 64 based on certain vehicle operating conditions, e.g., an accelerator pedal position and/or length of an engine run cycle. The time signals 15 may be used as an input to controller 24 for determining when to execute different portions of algorithm 100 as explained below with reference to FIG. 3.

Vapor circuit 28 includes various fluid control hardware components, including a switching valve 70, which is shown in one particular embodiment as a solenoid controlled device. Vapor circuit 28 further includes an absolute pressure sensor 72 adapted for determining whether sealed fuel system 30 has a leak, a pump 74 for creating a vacuum in the sealed fuel system 30, including within just the vapor circuit or in the entire sealed fuel system as set forth herein, and a control orifice 76 to which the absolute pressure sensor may be calibrated, e.g., for leak detection purposes.

Controller 24 is in communication with the vapor circuit 28, and uses portions of the circuit as a diagnostic tool when executing algorithm 100. That is, controller 24 selectively actuates the switching valve 70 during certain threshold vehicle conditions while the engine 12 is running, and monitors absolute pressure in the vapor circuit 28 using the absolute pressure sensor 72 when the switching valve is actuated. That is, when the pump 74 is off and the switching valve 70 is set to a first position, i.e., a "vent" position, the absolute pressure sensor 72 effectively measures atmospheric pressure. When the switching valve 70 is set to a second position, i.e., a "pump" position, with the pump 74 remaining off so as not to spin when vacuum is delivered through the open control valve 56, the absolute pressure sensor 72 effectively measures the vacuum in the fuel system 30. If the measured vacuum exceeds a calibrated vacuum level, i.e., if the measured vacuum is at a sufficiently high level, the controller 24 determines that proper vapor purge functionality is present. The diagnostic test described below with reference to FIG. 3 may generate a passing result or diagnostic code when a threshold vacuum is measured by the absolute pressure sensor 72 and held for a calibrated duration, conditions which should properly indicate proper purge flow.

Controller 24 controls the open/closed or on/off status of each of the purge valve 50, the control valve 56, and the switching valve 70, as well as the on/off status of pump 74. Algorithm 100 may be executed once per trip, always when the engine 12 is running and pump 74 is off. Under such conditions, controller 24 transitions the switching valve 70 from a vent position to a pump position as noted above. Absolute pressure sensor 72 is then closely monitored by the controller 24, with readings from the absolute pressure sensor of the actual vacuum in the sealed fuel system 30 being compared to a calibrated vacuum level, i.e., if the measured vacuum is at a sufficiently high level, the controller determines that proper vapor purge functionality is present. Controller 24 then records a diagnosis of the sealed fuel system 30 using this information.

Figure 3:
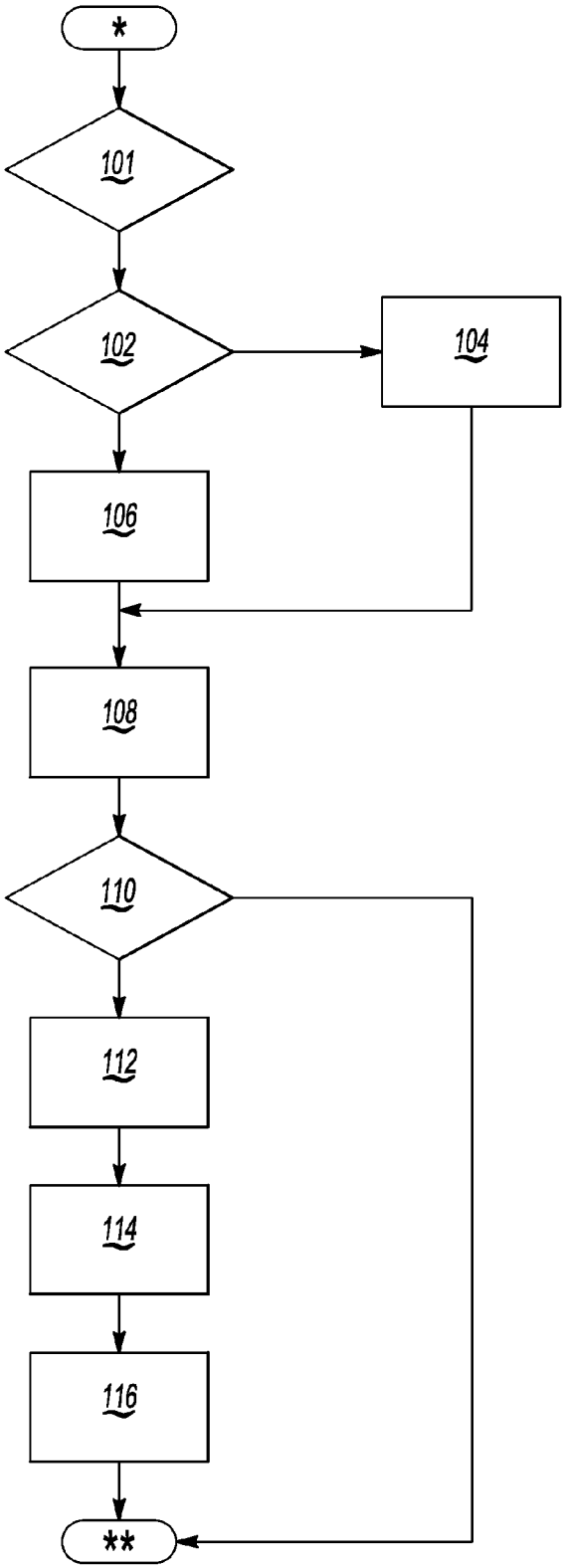
FIG. 3 is a flowchart describing a possible embodiment of the present diagnostic algorithm.

Referring to FIG. 3 in conjunction with the structure shown in FIG. 2, algorithm 100 commences as indicated by the (*) symbol, and begins with step 101, wherein the controller 24 or other suitable device determines whether engine 12 is running. If so, the algorithm 100 proceeds to step 102. If the engine 12 is not running, the algorithm 100 is finished.

At step 102, readings are taken by FT pressure sensor 63 and processed by the controller 24 to determine if a vacuum is present in the sealed fuel system 30. If so, the algorithm 100 proceeds to step 104. If a positive pressure is determined at step 102 instead of a vacuum, the algorithm 100 proceeds to step 106.

At step 104, having determined at step 102 that a vacuum is present in the sealed fuel system 30, the controller 24 simultaneously opens the purge valve 50 and the control valve 56. The algorithm 100 then proceeds to step 108.

At step 106, having determined at step 102 that a positive level of pressure is present in the fuel system 30, the controller 24 first opens the purge valve 50, and then opens the control valve 56 after a sufficient amount of time has passed to allow the pressure to reach zero or a suitable low non-zero threshold pressure level. The algorithm 100 then proceeds to step 108.

At step 108, controller 24 initiates a calibrated delay before executing the subsequent diagnostic steps of algorithm 100. The length of the delay may vary depending on whether a vacuum or a pressure was determined at step 102, and allows the fuel tank 36 to reach a calibrated level. The delay provided by step 108 allows the diagnostic to continue in the presence of a failed purge valve 50, thus enabling detection of a failed purge valve as set forth below. The algorithm 100 proceeds to step 110 once the calibrated delay is complete.

At step 110, the diagnostic continues, doing so even if the FT pressure sensor indicates that pressure remains in the fuel tank 36, as it is possible that the purge valve 50 has failed in a closed position, i.e., that pressure cannot be purged in the usual manner. Step 110 determines whether a requested purge flow and a level of engine vacuum are above calibrated thresholds. The algorithm 100 proceeds to step 112 when all thresholds are met. If the conditions in step 110 are not met after a calibrated time, the algorithm 100 is finished for that trip without the controller 24 making a decision, as indicated by the () symbol in FIG. 3**.

At step 112, controller 24 transitions the switching valve 70 of vapor circuit 28 from a first/vent position to a second/pump position, as shown in FIG. 3. The absolute pressure sensor 72 is monitored, and its readings are temporarily recorded in memory. The algorithm 100 then proceeds to step 114.

At step 114, the controller verifies the measurements taken at step 112 against a calibrated or threshold vacuum. As noted above, when the engine 12 is running and the pump 74 is off, switching valve 70 is set to the pump position such that vacuum in the sealed fuel system 30 can be read by the absolute pressure sensor 72. If absolute pressure sensor 72 shows that the measured vacuum exceeds the calibrated vacuum, i.e., if a predetermined vacuum differential is determined between the measured and calibrated vacuums, the controller 24 may execute a suitable control action. For example, the controller 24 may record or cause the recording of a passing diagnostic code in response to a vacuum measurement exceeding the calibrated vacuum, which may be read by a vehicle maintenance person and/or transmitted to a remote location, e.g., as part of a vehicle telematics unit. Otherwise, the controller 24 records a diagnostic code indicating low purge flow in the sealed fuel system 30.

At step 116, the controller 24 may allow a calibrated amount of time to pass after the diagnostic results are reported at step 114. This delay can allow vacuum in the fuel tank 36 of FIG. 1 to bleed down before completing the diagnostic steps, which may help to prevent fuel tank protection logic (not shown) from executing prematurely. The algorithm 100 is then finished, as indicated by the () symbol in FIG. 3**.

While the best modes for carrying out the invention have been described in detail, those familiar with the art to which this invention relates will recognize various alternative designs and embodiments for practicing the invention within the scope of the appended claims.

The invention claimed is:

1. A vehicle comprising:

an internal combustion engine;

a sealed fuel system having a fuel tank, a canister for storing fuel vapor from the fuel tank, a vapor circuit positioned external to the fuel tank and in fluid communication with the fuel tank, and a control valve for controlling a flow of fuel vapor from the vapor circuit into the canister, wherein the vapor circuit includes an absolute pressure sensor, a pump, and a switching valve selectively connecting the fuel tank to the absolute pressure sensor when the control valve is open; and a controller having an algorithm, the execution of which by the controller causes the controller to diagnose a vapor purge function of the sealed fuel system using vacuum measurements from the absolute pressure sensor;

wherein the controller is configured to execute the algorithm only when the engine is running, vapor purge is enabled, and the pump is off, and diagnoses the vapor purge function while the pump remains off by comparing the vacuum measurements to a calibrated vacuum.

2. The vehicle of claim 1, wherein the controller actuates the switching valve to thereby place the pump in fluid communication with the rest of the sealed fluid system, and thereafter measures the vacuum in the sealed fuel system using the absolute pressure sensor to thereby determine the vacuum measurements.

3. The vehicle of claim 1, wherein the controller executes the algorithm at least once per trip of the vehicle.

4. The vehicle of claim 1, further comprising a purge valve selectively connecting the canister to the engine, and a fuel tank pressure sensor adapted for measuring a gauge pressure level in the fuel tank, wherein the controller opens the purge valve and the control valve simultaneously when the fuel tank pressure sensor measures a vacuum in the fuel tank, and opens the purge valve a calibrated amount of time before the control valve when the fuel tank pressure sensor measures a pressure in the fuel tank.

5. The vehicle of claim 4, wherein the controller is configured to execute a time delay equal to a first delay value when the fuel tank pressure sensor detects a vacuum in the fuel tank, and equal to a second delay value when the fuel tank pressure sensor detects a pressure in the fuel tank.

6. The vehicle of claim 5, wherein the controller executes the algorithm after the second delay even when pressure remains in the fuel tank.

7. An apparatus for use aboard a vehicle having a sealed fuel system, the sealed fuel system having a fuel tank, a canister for storing fuel vapor from the fuel tank, and a control valve for controlling a flow of fuel vapor into the canister, the apparatus comprising:

a vapor circuit positioned external to the fuel tank and in fluid communication with the fuel tank and the control valve, and having an absolute pressure sensor, a pump, and a switching valve selectively connecting the fuel tank to the absolute pressure sensor when the control valve is open; and a controller having an algorithm for evaluating or diagnosing a vapor purge function of the sealed fuel system using vacuum measurements from the absolute pressure sensor;

wherein the controller is configured to execute the algorithm only when the engine is running, vapor purge is enabled, and the pump is off, and diagnoses the vapor purge function while the pump remains off by comparing the vacuum measurements to a calibrated vacuum.

8. The apparatus of claim 7, wherein the controller actuates the switching valve to place the pump in fluid communication with the rest of the sealed fluid system, and thereafter measures the vacuum in the sealed fuel system using the absolute pressure sensor to thereby determine the vacuum measurements.

9. The apparatus of claim 8, wherein the controller executes the algorithm at least once per trip of the vehicle.

10. The apparatus of claim 8, the vehicle further including a fuel tank pressure sensor, wherein the controller simultaneously opens the purge valve and the control valve when the fuel tank pressure sensor detects a vacuum in the fuel tank, and opens the purge valve a calibrated amount of time before the control valve when the fuel tank pressure sensor detects a pressure in the fuel tank.

11. The apparatus of claim 8, wherein the controller executes a variable time delay before executing the algorithm and after the purging of the fuel vapor is enabled, the variable time delay being equal to a first value when the fuel tank pressure sensor detects the vacuum, and to a second value when the fuel tank pressure sensor detects the pressure.

* * * * *